United States Patent [19]

MacIntyre

[11] Patent Number: 4,879,700

[45] Date of Patent: Nov. 7, 1989

[54] METHOD AND APPARATUS FOR DETERMINING THE TIME BETWEEN TWO SIGNALS

[75] Inventor: Alan D. MacIntyre, Irvine, Calif.

[73] Assignee: Ball Corporation, Muncie, Ind.

[21] Appl. No.: 45,355

[22] Filed: May 4, 1987

[51] Int. Cl.[4] ..... G04F 8/00

[52] U.S. Cl. ..... 368/117; 368/120

[58] Field of Search ..... 368/113–120

[56] References Cited

U.S. PATENT DOCUMENTS 4,620,788 11/1986 Giger ..... 368/118

4,657,406 4/1987 Yaeda ..... 368/120

FOREIGN PATENT DOCUMENTS 970302 10/1982 U.S.S.R. ..... 368/118

OTHER PUBLICATIONS

Digital Meter of Time Intervals with Picosecond Resolution & Wide Dynamic Range, Instruments & Experimental Techniques, vol. 17, No. 6, Pt. 1, pp. 1647–1651, Nov.–Dec. 1974, Plenum Publishing Corp.

PC–10 Operation Manual Ball Efratom Division Portable Atomic Clock/Frequency Standard, 2/86.

*Primary Examiner*—Bernard Roskoski

*Attorney, Agent, or Firm*—Gilbert E. Alberding

[57] ABSTRACT

A time interval counter permits the time interval between a first signal and one of a series of timing signals to be measured to less than ±2 nanoseconds without using microwaves and high power-consuming devices. The time interval counter uses a first passive delay time operated from the first signal, which occurs at an unknown interval from the timing signals, to produce a plurality of binary outputs spaced from each other by known equal time intervals that are substantially less than the interval between the timing signals, and a second passive delay line operated by the timing signal, which occurs after the first signal, to produce a plurality of sequential outputs spaced from each other by a plurality of known sub-time intervals that are substantially less than the time interval between the plurality of binary outputs of the first delay line. The time interval counter also includes means to store the plurality of binary outputs of the first delay line at each of the sub-time intervals produced by the second delay line, and means to determine the time interval between the first signal and timing signal from the stored binary outputs of the first delay line by interpreting the earliest stored binary outputs and the stored binary outputs at each sub-time interval and combining the interpretation and comparison to calculate the time interval.

14 Claims, 14 Drawing Sheets

CONT. ON 3B & 3F
IPPS
J1
10MHz
TO BOARD 2
20
CK
CL
L
CO
S
G
CLEAR TCO
CLEAR IPPS
TIC FLAG
D7
D6
D5
D4
D3
D2
D1
D0
ALSB2
ALSB1
CK'
IPPSIN
RETURN
+5
310
311
330
331
320
320a
320b
74AC161 U1
74AC160 U2
74HC157 U8
74HC373 U9
Vcc ENT GRD ENP L CO
CK A B C D QA QB QC QD CL
ENP
S GRD G Vcc
1Y 2Y 3Y 4Y
4B 3B 2B 1B
4A 3A 2A 1A
1Q 2Q 3Q 4Q 5Q 6Q 7Q 8Q
OC G GRD

CONT. ON 3C
210
A
B
C
D
E
F
+5
Vcc
ENP
ENT
CK
A B C D GRD
74AC160 U3
CO
QA QB QC QD
CL
312
74AC160 U4
313
332
333
321
74HC373 U10
1Q 2Q 3Q 4Q 5Q 6Q 7Q 8Q
OC
G
GRD
321b
321a

CONT. ON 3D & 3G
G
H
J
K
+5
74AC160 U5
74AC160 U6
ENP
ENT
CK
Vcc
A B C D GRD
QA QB QC QD
CO
CL
314
315
334
335
322
74HC373 U11
1Q 2Q 3Q 4Q 5Q 6Q 7Q 8Q
OC
G
GRD
322a
322b
NC
74HC138 U22
Y0 Y1 Y2 Y3 Y4 Y5 Y6 Y7
G2B G2A G1
C B A
A3 EN R/W
A2 A1 A0

CONT. ON 3E

CONT. ON 3G

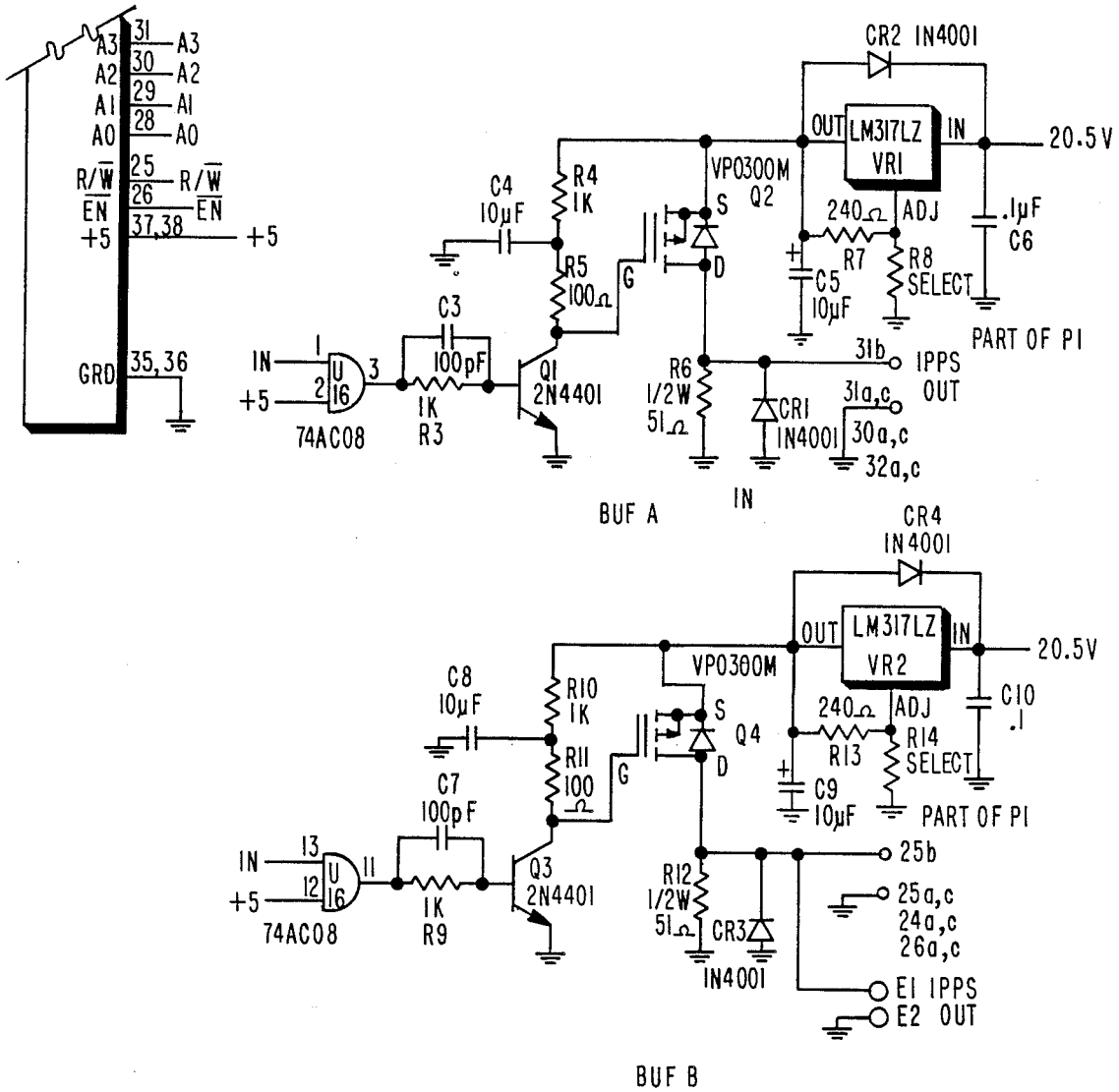
Fig.3F
CONT. FROM 3A
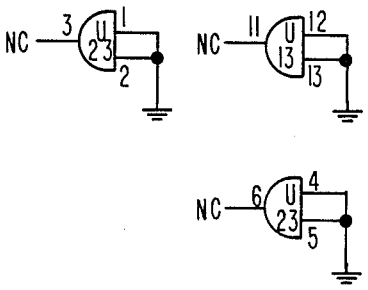

CONT. FROM 3C & 3E

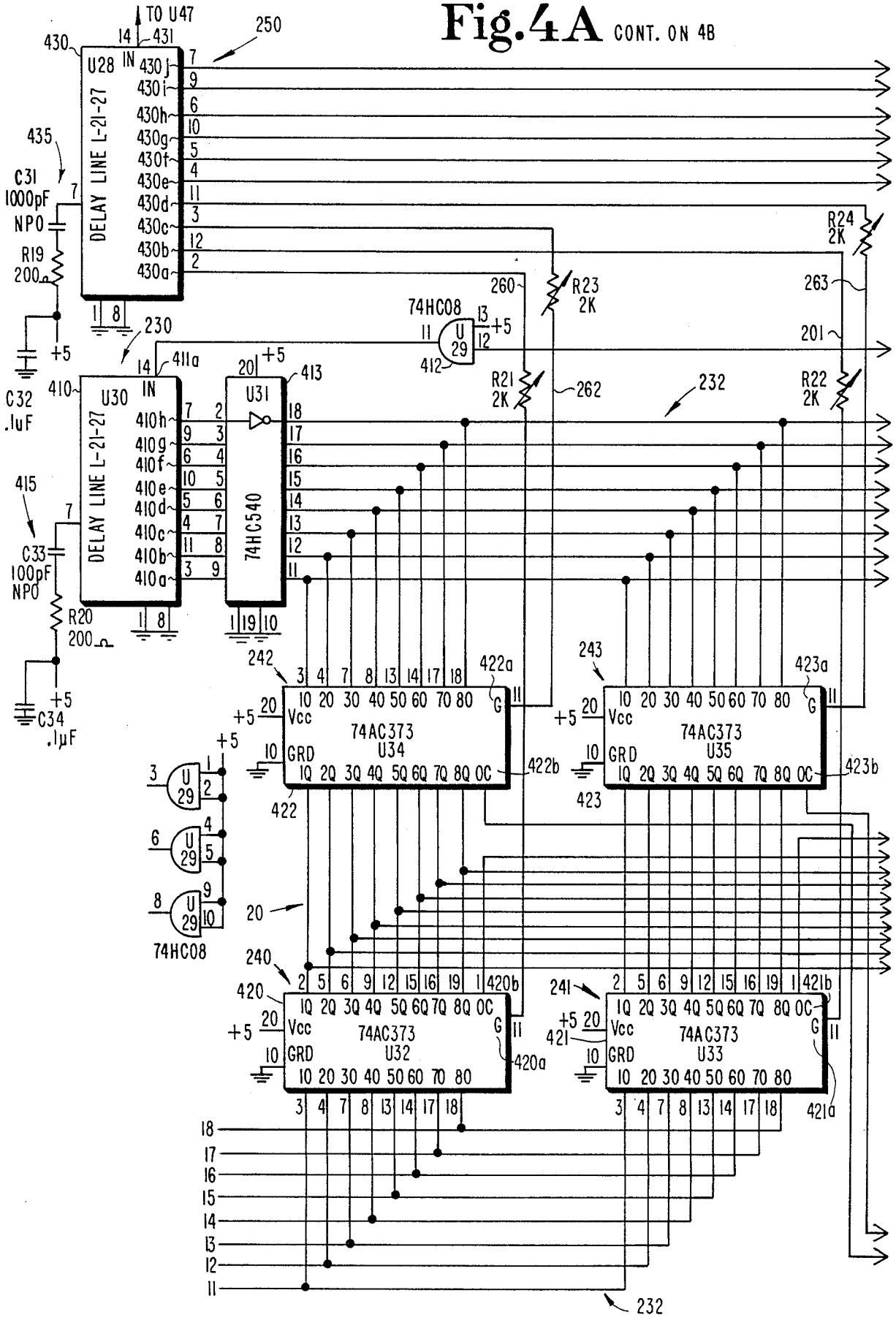
Fig. 4A CONT. ON 4B

Fig. 4B CONT. ON 4C
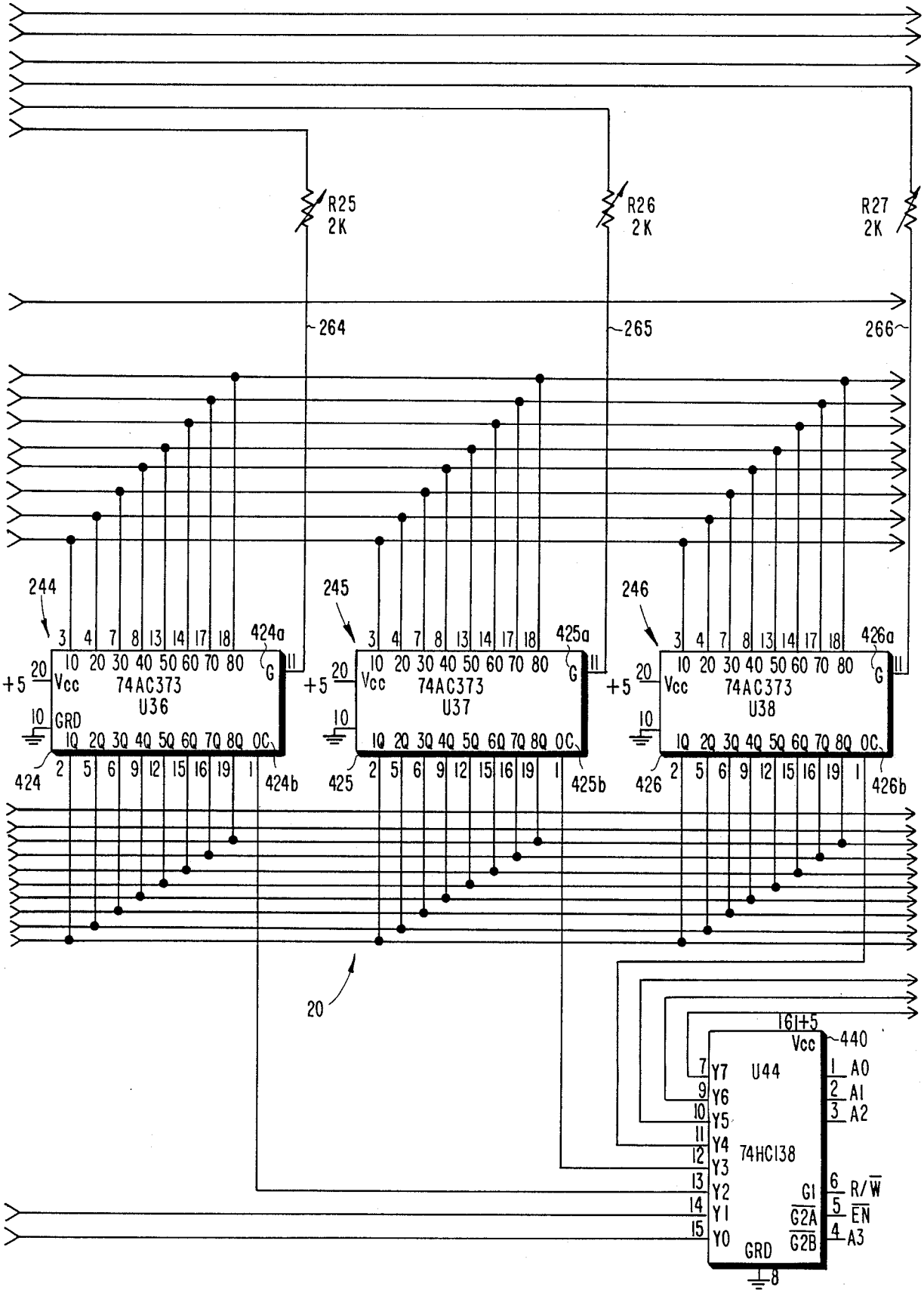

CONT. ON 4D

Fig.4D CONT. ON 4E
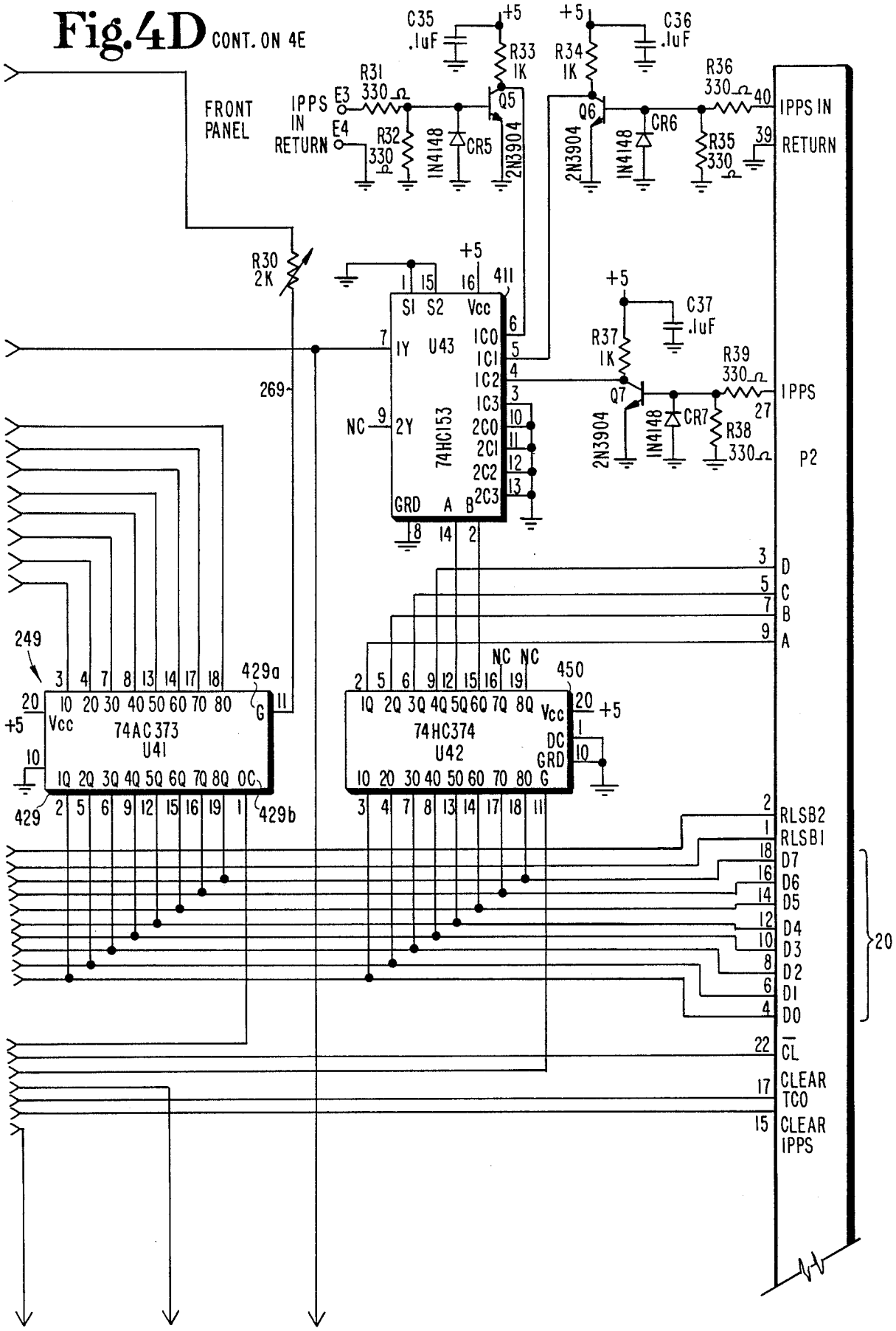

CONT. FROM 4D

METHOD AND APPARATUS FOR DETERMINING THE TIME BETWEEN TWO SIGNALS

BACKGROUND OF THE INVENTION

This invention relates, in general, to time interval counters and, more particularly, to a time interval counter that may be incorporated into an atomic clock and provide improved means to determine the time interval between an internally generated time signal and an external standard time signal.

An atomic clock is a device to generate the time of day, time signals, and, frequently, standard frequency outputs from highly stable, internal, atomic oscillators, such as atomic rubidium oscillators. In such atomic clocks, highly stable frequencies are generated by the electronic emissions experienced in the transition between two energy levels of an atom or molecule. Such transitions generally occur in the microwave region of the electromagnetic spectrum and provide a highly stable frequency reference to which the frequency of a voltage-controlled, crystal oscillator (VCXO) can be electronically locked. The high frequency stability associated with an atomic reference frequency is transferred to a voltage-controlled, crystal oscillator. Hydrogen, cesium, and rubidium frequency standards can be used in atomic clocks to stabilize, usually, a five MHz, or ten MHz, quartz crystal oscillator.

In portable atomic clocks, rubidium atomic oscillators are preferred because of their small size and their contribution to portability. By slaving a voltage-controlled, quartz, crystal oscillator to the frequency of atomic transition of rubidium, the tendency of the quartz, crystal oscillator to drift through aging and other environmental effects can be markedly suppressed. Temperature and pressure changes, however, affect the frequency of the rubidium standard, and the atomic clock runs faster or slower, depending upon the change. Portable atomic clocks are usable to transfer precise times from one location to another and to calibrate remotely located equipment which needs a precise time of day to operate reliably and as desired. Such uses include equipment needing "flying clocks", geophysical survey-positioning systems, bistatic radar systems, and precise time-keeping systems. It is thus desirable to determine the time interval between the time signals generated by such a clock to "set" the portable clock with a standard time and to measure and compensate for the clock's drift.

Time interval counters for atomic clocks are known; however, the known atomic clocks were capable of measuring time intervals to only ± 20 nanoseconds accuracy and of synchronizing an internally generated time signal with an external standard time signal to an accuracy of only ± 50 nanoseconds.

BRIEF SUMMARY OF THE INVENTION

This invention permits a time interval between two signals to be measured to less than ± two nanoseconds, while avoiding microwave electronics and high power consumption.

A time interval counter of the invention includes a first means, operated by an external signal occurring at an unknown time interval, for producing a plurality of binary outputs spaced from each other by a plurality of known equal time intervals. The plurality of time intervals generated by the first means is substantially less than the time interval between a series of timing signals of known frequency that, with the external signal, define the unknown time interval. This plurality of binary outputs can represent, in coded form, the time interval following the first signal.

The time interval counter of the invention also includes a second means, operated by the timing signal of known frequency next following the external signal, for producing a plurality of sequential outputs spaced from each other by a plurality of known sub-time intervals that are substantially less than the time interval between the plurality of binary outputs of the first means.

The time interval counter further includes means for storing the plurality of binary outputs and coded representations of the time interval after the external signal at each of the sub-time intervals produced by the second means, and means for determining the time interval between the external signal and timing signal next following the external signal from the stored binary signals and coded representations, by interpreting the earliest stored coded representation, by comparing the coded representations of the sub-time intervals to determine the number of sub-time intervals represented by the next change in the stored coded representations, and by combining the interpretation and sub-time determination to calculate the time interval between the external signal and the next occurring timing signal.

The invention permits the use of the developed, atomic-clock technology using frequency generators in the ten MHz. frequency range stabilized by atomic, rubidium oscillators and avoids the generation of microwave frequencies on the order of, for example, one gigahertz. In the invention, the 100-nanosecond interval of a rubidium-stabilized ten MHz standard frequency generator is divided into sub-subintervals of about one nanosecond through a unique combination of pulse, binary, and analog electronic techniques.

In such an atomic clock application of the invention, the time interval between the internally generated time signal of the clock and an external standard time signal is first determined in a manner known in the art, by counting the number of 100-nanosecond intervals between the two signals. The portion of the time interval less than 100 nanoseconds is determined by forming the two signals as pulses and delaying the pulses to provide a plurality of signals at subintervals and sub-subintervals of the 100-nanosecond period. Thus, in this preferred application of the invention, the first means is a delay line providing a plurality of outputs uniformly spaced throughout the 100-nanosecond period. Conveniently, the first delay line provides eight outputs at 12.5-nanosecond intervals, as the first pulse, which represents the external standard time signal, travels through the delay line. The eight outputs comprise a plurality of binary outputs representing the subintervals of time less than 100 nanoseconds after the external time standard. The second means is also a delay line, and the sub-subintervals of time are generated by applying a pulse generated from the ten MHz frequency standard timing signals to this delay line and dividing the time subinterval of the first means into a plurality of sub-subintervals of time, with a signal output at each sub-subinterval of time. Conveniently, the second delay line provides ten outputs, each output being delayed in time 1.25 nanoseconds from the previous output as the second timing pulse travels down the second delay line.

The binary outputs of the first delay line, which can be considered, at any instant of time, as a binary coded representation of the time interval after the external standard time signal, are stored at each sub-subinterval of time, beginning at the time of the second timing pulse. A central processing unit then determines the time interval between the external standard time signal and the timing signal generated from the ten MHz frequency standard, from the stored binary outputs of the first delay line and from the sub-subinterval of time at which the output of the first delay line changes.

Thus the interval T between an external time signal and an internal time signal is determined by producing a series of timing signals having f precise periods of time, 1/f, with f being many times greater than the reciprocal of T. The time interval T is first determined by counting the number of time periods 1/f between the first signal and the second signal. The portion of the time interval that is less than 1/f is determined by processing the first signal to produce n sequential outputs equally spaced in time and commencing at times delayed from each other by periods of $$\frac{1}{n \times f},$$

processing the second timing signal occurring next after the first signal to produce p sequential outputs, each of the p sequential outputs being equally spaced in time and commencing at times delayed from each other by periods of $$\frac{1}{p \times n \times f},$$

sampling the n outputs at times corresponding to each of the p sequential outputs and storing the sampled n outputs, reading the stored sampled n outputs and comparing the stored n outputs to determine the $$\frac{1}{p \times n \times f}$$

period when a mismatch occurs in the stored n outputs, and calculating the time interval between the first signal and the second timing signal to an accuracy of $$\frac{1}{p \times n \times f}$$

from the sampled n outputs and the $$\frac{1}{p \times n \times f}$$

period hat which a mismatch in the sampled n outputs is detected.

An atomic clock with a time interval counter of this invention can be used to transfer time precisely from a standard time reference to a remotely stationed clock. The invention contributes to such a clock, the ability to measure the time interval between a standard reference time and the time of the atomic clock with an error of less than ± two nanoseconds. Because the invention permits comparison of an internally generated time with a standard reference time with so little error, the effect of environmental changes and the drift error associated with the clock can be accurately measured and compensated for during a transfer trip. Thus, an atomic clock incorporating this invention permits someone to carry standard time from a known time standard to a remotely stationed clock with substantially improved accuracy.

The drawings and the descriptions which follow illustrate a preferred embodiment of this invention and further explain the principals and features of the invention. Other features of the invention will be apparent from the drawings and description of the preferred embodiment.

DESCRIPTION OF THE PREFERRED EMBODIMENT

Figure 1:
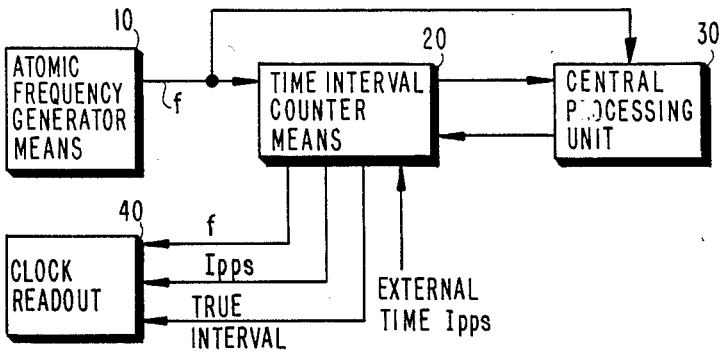
FIG. 1 is a block diagram of an atomic clock illustrating its major components.

An atomic clock is illustrated in the block diagram of FIG. 1. As shown in FIG. 1, the atomic clock includes an atomic frequency generation means 10, a time interval counter means 20, a central processing unit, or microprocessor, 30, and a readout 40 capable of providing time of day and time interval information in a digital format.

Atomic frequency generation means 10 generates a high frequency of, for example, ten MHz, using an atomic frequency generator, preferably a rubidium atomic frequency oscillator, to stabilize the frequency generation means. The atomic frequency generation means 10 is well known in the art and is not described in any detail herein.

As shown in FIG. 1, the output of the frequency generation means (f) is applied to the time interval counter means 20. The time interval counter means 20 develops an internally generated time signal, preferably one pulse per second, and can determine the time interval between an internally generated time signal of one pulse per second and an external standard time signal of one pulse per second to ± 100 nanoseconds. The details of the clock readout 40 are well known in the art and are not described here.

Figure 2A:
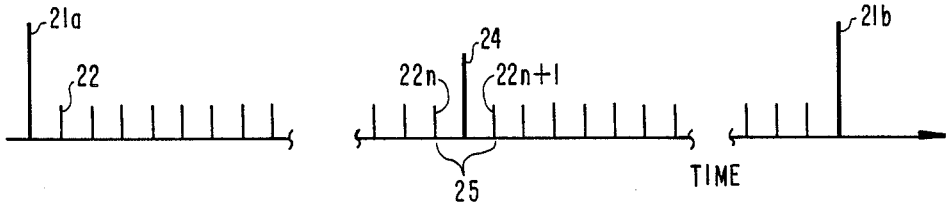
FIG. 2A is a diagram showing the relationship of internally generated one-second signals of an atomic clock and an externally generated time signal offset in time by an unknown time interval and a plurality of 100-nanosecond divisions of one second.
Figure 2B:
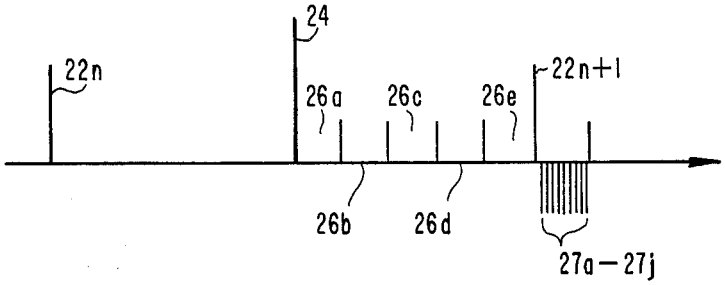
FIG. 2B is a diagram showing the 100 nanosecond time interval of FIG. 2B in which an external time signal of FIG. 2A occurs, and illustrates how the invention creates subintervals and sub-subintervals of time to determine a time interval with an accuracy greater than ± 100 nanoseconds.

As shown in FIGS. 2A and 2B, an atomic clock can generate time signals 21*a* and 21*b* at accurate onesecond intervals by counting ten million pulses 22 generated from an atomic frequency-stabilized, ten MHz frequency generator. An externally generated signal 24, which may be the one-second signals of a standard time reference or standard clock, occurs between the internally generated one-second signals 21*a* and 21*b*. The time interval T between signal 24 and signal 21*a* or 21*b* can be determined to ± 100 nanoseconds (the time interval between the timing signals 22) by counting the number of timing signals 22 between pulse 24 and either of the timing signals 21*a* or 21*b*.

This invention permits the time interval between signal 24 and either of signals 21*a* or 21*b* to be determined to less than ± two nanoseconds. For convenience in describing the invention, the 100-nanosecond interval 25 between timing signals 22*n* and 22*n*+1, in which the pulse 24 occurs, is shown in FIG. 2B.

In the invention, the time after the signal 24 is divided into a plurality of subintervals of time, for example, including 26*a* through 26*e*. The time after the second timing signal 22*n*+1 is divided into sub-subintervals of time 27*a* through 27*j*, and the time interval between the pulse 24 and either of timing pulses 22*n* or 22*n*+1 is determined from the subintervals 26 and sub-subintervals 27.

Figure 2C:
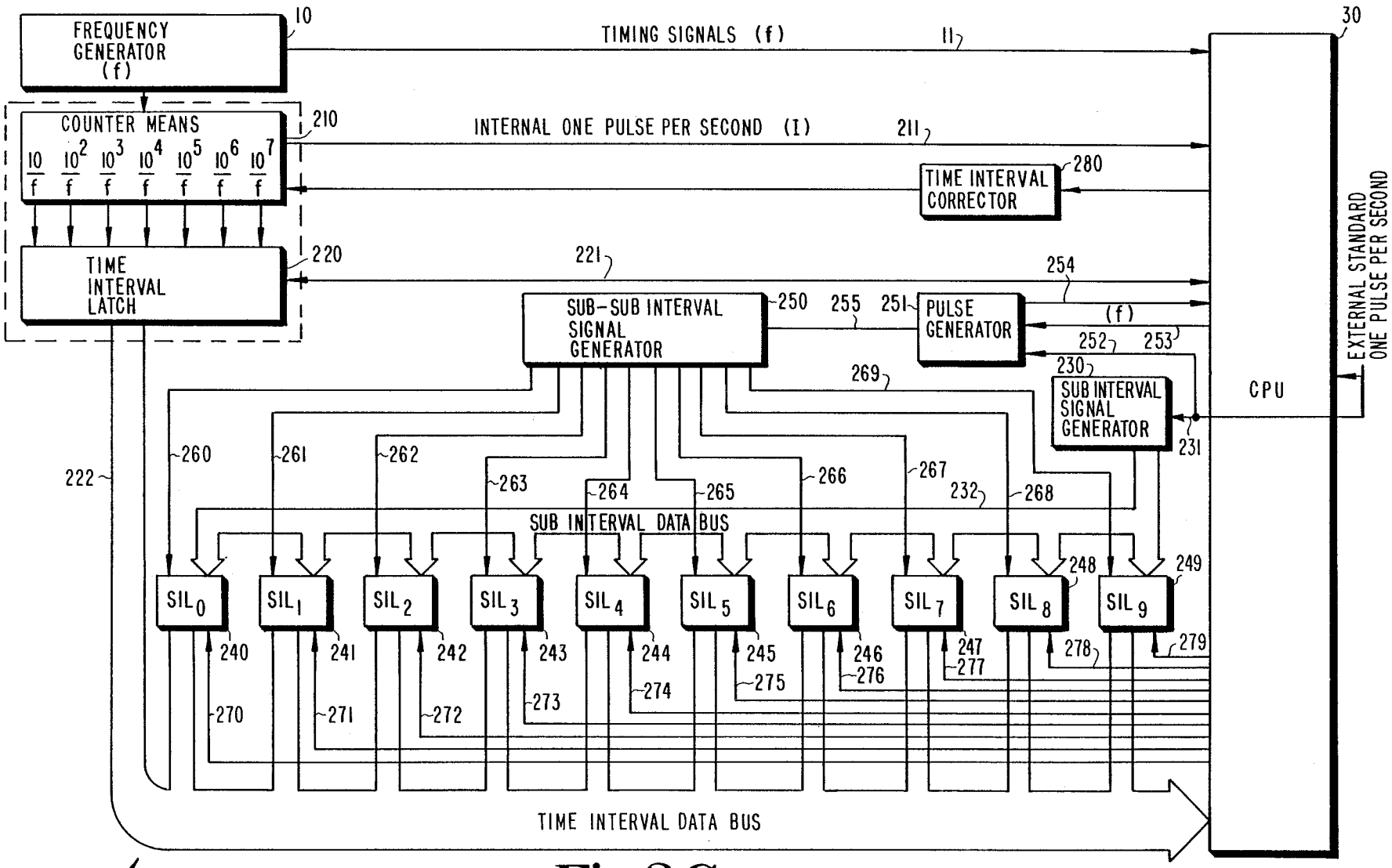
FIG. 2C is a block diagram of a preferred embodiment of the time interval counter of this invention.

FIG. 2C is a block diagram showing the major elements of the preferred embodiment of the time interval counter means 20 and its relationship with frequency generator 10 and central processing unit 30. FIG. 2C is simplified by the omission of circuit elements to permit a clear understanding of the major elements of the time interval counter means and its method of operation. The operation of the time interval counter is described as if the time signal pulses have instantaneous rise times and constant amplitudes (i.e., have a square wave format) although such ideal signals are not achieved in practice. Those skilled in the art will be able to achieve the invention with real-time signals and components.

FIGS. 3A through 3G and 4A through 4E are the schematic drawings of the complete circuit of time interval counter means 20. Although the invention can operate with a frequency generator 10 providing other frequencies, the preferred embodiment of this invention employs an atomic frequency generator providing a stable and accurate ten-MHz frequency.

As shown in FIG. 2C, the time interval counter means 20 includes counter means 210. Counter means 210 comprises preferably a plurality of counters to count pulses generated from the ten-MHz output of the frequency generator 10 and provide an output pulse at the end of ten million cycles, or one pulse per second such as pulses 21*a* and 21b of FIG. 2A. This internally generated one pulse per second comprises a secondary standard which may be used to develop an accurate time of day and provide accurate timing signals to other equipment.

The time interval between the internal time signal and the external time signal is first measured to ± 100 nanoseconds accuracy by counter means 210 and time interval latch 220. Accurate 100-nanosecond time intervals are generated by the periods between a series of timing pulses (shown as 22 in FIGS. 2A and 2B) generated from the atomic frequency generator 10. The number of 100-nanosecond time intervals between the internal one pulse per second and the external time standard are counted by the combined operation of counter means 210 and time interval latch 220. Beginning with the leading edge of the internally generated one pulse per second, counter means 210 counts the number of timing pulses (i.e., 100-nanosecond time intervals) in decades; and the count in decades from counter means 210 is connected with time interval latch 220 as shown in FIG. 2C. Upon detection of the leading edge of the external standard one pulse per second, the time interval count from counter means 210 is latched, or stored, after the current 100 nanosecond interval has propagated through the counter means 210, in time interval latch 220 and read by the central processing unit. Central processing unit 30 stores the number of 100-nanosecond time intervals that were counted between the internally generated one pulse per second and the external standard one pulse per second. This measurement, as known in the art, determines the time interval between the internal one pulse per second and the external standard one pulse per second to ± 100 nanoseconds.

In the invention, the time interval between the internal one pulse per second and the external standard one pulse per second is then determined to an accuracy of ± two nanoseconds. This determination begins with the receipt of the external standard one pulse per second.

The external standard pulse (shown as pulse 24 in FIG. 2B) is applied to a subinterval signal generator 230 over connection 231. The external standard pulse generally has a pulse length greater than 100 nanoseconds. Subinterval signal generator 230 provides a plurality of outputs equally spaced in time (as shown, for example, by 26*a*–26*e* of FIG. 2B) during the 100-nanosecond time interval. In the preferred embodiment, subinterval signal generator 230 comprises a passive delay line to which the external standard pulse is applied, having eight, uniformly delayed outputs changing from low, "0", to high, "1", as the leading edge of the external standard pulse passes. The outputs of such a subinterval signal generator provide eight outputs changing from 0 to 1 at, respectively, 12.5, 25, 37.5, 50, 62.5, 75, 87.5, and 100 nanoseconds after the arrival of the external standard pulse.

The eight digital outputs of the subinterval signal generator 230 are connected with subinterval data bus 232 and provide, at any instant of time, a digitally coded representation of the time interval following the external standard time signal pulse on line 231. The subinterval data bus 232 provides the digitally coded output of subinterval signal generator 230 simultaneously at the inputs of ten subinterval latches SIL0–SIL9, numbered, respectively, 240–249 on FIG. 2C. The subinterval latches 240–249 are transparent to the output of the subinterval signal generator 230 unless latched.

In the invention, a sub-subinterval generator 250 operates the subinterval latches 240–249 to permit resolution of the time interval between the internally generated one pulse per second and the external standard one pulse per second to less than ± two nanoseconds. The sub-subinterval generator 250 is operated from a pulse generated by pulse generator 251. Pulse generator 251 is prepared by the arrival of the external standard pulse on connection 252 and the incidence of timing pulses originating from the atomic frequency generator 10, and generates a timing pulse to operate the sub-subinterval signal generator upon receipt of the next timing signal from the frequency generator 10 over connection 253. The pulse generator 251 also generates a "flag" pulse over connection 254 to inform the central processing unit 30 that time interval measurement is occurring. The timing signal pulse from pulse generator 251 is applied to the sub-subinterval signal generator over line 255. Sub-subinterval signal generator 250 develops ten outputs 260–269 connected with subinterval latches 240–249, respectively, as shown in FIG. 2C.

In the preferred embodiment, sub-subinterval signal generator 250 can comprise a passive delay line to which the timing pulse is applied and having ten uniformly delayed outputs as the leading edge of the timing pulse passes. In the embodiment of FIGS. 3 and 4, the outputs 260–269 are equally spaced in time and delayed one from the other by intervals of about 1.25 nanoseconds after the timing pulse (as shown by pulse 22*n*+1 and sub-subtime intervals 27*a*–27*j* of FIG. 2B); that is, output 260 occurs 1.25 nanoseconds after the application of the timing pulse on line 251 to subinterval generator 250; output 261 occurs 2.50 nanoseconds after the application of the timing pulse to the sub-subinterval generator 250; output 262 occurs 3.75 nanoseconds after the timing pulse; and so on. Applications of the sub-subinterval signal generator outputs over lines 260–269 latch the subinterval latches 240–249 at, respectively, 0, 1.25 nanosecond, 2.5 nanoseconds, 3.75 nanoseconds, 5.0 nanoseconds, 6.25 nanoseconds, 7.5 nanoseconds, 8.75 nanoseconds, 10 nanoseconds, and 11.25 nanoseconds after the application of the timing pulse over connection 255 to the sub-subinterval generator 250.

Since the eight outputs of the subinterval generator 230 (providing a coded representation of the time interval after the external standard time pulse) are connected to the inputs of the ten subinterval latch means 240–249 over subinterval data bus 232, the coded representations of the time interval between the external standard pulse and the next timing pulse are latched in the subinterval latches 240–249 at uniform time intervals of 1.25 nanoseconds.

If, for example, the external standard pulse arrives at subinterval signal generator, or passive delay line 230, 43 nanoseconds after the last timing signal and, thus, 57 nanoseconds before the timing signal next following the external standard pulse, the leading edge of the external standard pulse will have traveled down the passive delay line 230 for 57 nanoseconds at the time of the timing signal that next follows the external standard pulse; and the external standard pulse will be producing outputs at the 12.5, 25, 37.5 and 50 nanosecond delay outputs of the passive delay line. These four outputs can be considered a 00001111 binary coded representation of the time interval after the external standard pulse, and are present at the inputs of each of the subinterval latch means 240–249 at the time of occurrence of the next timing pulse (and for the 7.0 nanoseconds before occurrence of the next timing signal).

The next timing pulse operates the sub-subinterval generator 250 and produces, in sequence, an output 260 at 0 time delay to latch subinterval latch means 240 and to store the 00001111 output of the subinterval signal generator 230; an output 261 at a 1.25 nanosecond delay after the timing pulse to latch subinterval latch means 241 and to store the 00001111 output of the subinterval signal generator 230; an output 262 at a 2.5-nanosecond delay after the timing pulse to latch subinterval latch means 242 and to store the 00001111 output of the subinterval signal generator 230; an output 263 at a 3.75-nanosecond delay after the timing pulse to latch subinterval latch means 243 and to store the 00001111 output of the subinterval signal generator 230; and an output 264 at a 5-nanosecond delay after the timing pulse to latch subinterval latch means 244 and to store the 00001111 output of the subinterval signal generator 230.

At a 6.25-nanosecond delay after the timing signal, the sub-subinterval signal generator 250 produces an output 265 and latches subinterval latch means 245. At this time, however, which is 63.25 nanoseconds after arrival of the external standard pulse, the external standard pulse has traveled down the passive delay line 230 for a sufficient time to produce an output at the 62.5-nanosecond delay output, and the coded representation of the time interval after the external standard pulse at the outputs of the subinterval signal generator is now 00011111. This coded representation of the time after the external standard pulse is stored in subinterval latch means 245, and each of the subinterval latch means 246–249 et seq. subsequently latched by the sub-subinterval signal generator 250 stores the 00011111 output of the subinterval signal generator 230.

After receiving the flag signal over connection 254, the central processing unit 30 reads the binary coded representations of the time interval after the external standard pulse that are latched in each of subinterval latches 240–249. The central processing unit 30 can determine from the binary coded representation stored in subinterval latch means 240 the time interval between the external standard one pulse per second and the timing signal to about ± 12.5 nanoseconds. In the example above, the central processing unit determines that a coded representation 00001111 in subinterval latch means 240 represents an interval of more than 50 nanoseconds, and less than 62.5 nanoseconds between the external standard pulse and the next timing pulse.

The central processing unit 30 also compares the coded representations stored in subinterval latch 240 with the binary coded outputs stored in each of the other subinterval latches 241–249 to determine the earliest mismatch between their stored coded representations. The central processing unit 30 determines from the comparison, the number of 1.25-nanosecond time intervals present in the time interval from the next timing pulse to the next change in the outputs of the subinterval generator caused by the external standard one pulse per second. In the example above, the central processing unit 30 determines that the outputs of subinterval generator 230 changes after 5 nanoseconds and before 6.25 nanoseconds after the next timing signal and that the time interval between the time of change in the 50-nanosecond output of subinterval time generator 230 and the next occurring timing pulse is thus greater than 6.25 nanoseconds and less than 7.5 nanoseconds. The total time interval between the external standard pulse and the next occurring timing pulse is therefore determined to be between 56.25 nanoseconds and 57.5 nanoseconds, or between 42.5 nanoseconds and 43.75 nanoseconds between the external standard pulse and the preceding timing pulse.

With this information, the central processing unit 30 can thus determine the total time interval between the internally generated one pulse per second and external standard one pulse per second by combining the number of 100-nanosecond intervals between the two signals, the time interval corresponding to the coded representation of the subinterval signal generator 230 stored in the first subinterval latch 240 at the time of the next timing pulse, and the number of 1.25-nanosecond intervals representing the time between the change in outputs of the subinterval signal generator 230. In the preferred embodiment described above, the time interval determined by central processing unit 30 is accurate to less than ± 1.25 nanoseconds.

In operation, frequency generator 10 produces a series of timing signals having precise periods of time 1/f between each signal of the series. To obtain accurate determinations of time interval, the frequency f is many times greater than the reciprocal of the time interval T to be determined. In the preferable embodiment of this invention described above, the frequency f is ten MHz. The number of periods 1/f between a initially generated time signal and a second external signal are counted by the combined action of counter means 210, time interval latch 220, and central processing unit 30, and the number of periods 1/f are stored in a central processing unit.

The external signal is processed, for example, by a subinterval signal generator 230, to produce n sequential outputs that are equally spaced in time and commencing at times delayed from each other by subintervals of $$\frac{1}{n \times f}.$$

The n outputs are sampled at p precise sub-subintervals of time, and the sampled outputs are stored. The next timing signal is processed to produce the p outputs. The p outputs are equally spaced in time and commence at times delayed from each other by sub-subintervals $$\frac{1}{p \times n \times f}.$$

The p outputs generated from the next timing signal (as, for example, by subinterval signal generator 250) are used to sample and store the n outputs.

The stored sampled n outputs are read at each of the $$\frac{1}{p \times n \times f}$$

subintervals and compared to determine the $$\frac{1}{p \times n \times f}$$

subinterval at which a mismatch occurred. The time interval between the first and second signals is computed from this information.

In the time interval counter, subinterval generator 230 thus forms a first means, operated by the external signal, for producing a plurality of binary outputs spaced from each other by a plurality of equal time intervals that are substantially less than the time interval between the series of timing signals generated by the frequency generator 10. The plurality of outputs can represent, in binary coded form, the time interval following the external pulse.

Sub-subinterval signal generator 250 forms a second means, operated by the timing signal next following the external signal, for producing a plurality of sequential outputs spaced from each other by a plurality of sub-time intervals that are substantially less than the time interval between the plurality of binary outputs of the subinterval generator 230.

The subinterval latch means 240–249 and the central processing unit form third means for storing the plurality of binary outputs from the first means (the coded representations of the time interval after the external pulse) at each of the sub-time intervals produced by the second means, and for determining the time interval between the external signal and timing signal from the stored binary outputs (coded representations), by interpreting the coded representations, by comparing them at each sub-time interval to determine the number of sub-time intervals represented by the change in stored coded representations, and by combining the interpretation and determination.

Figure 3A:
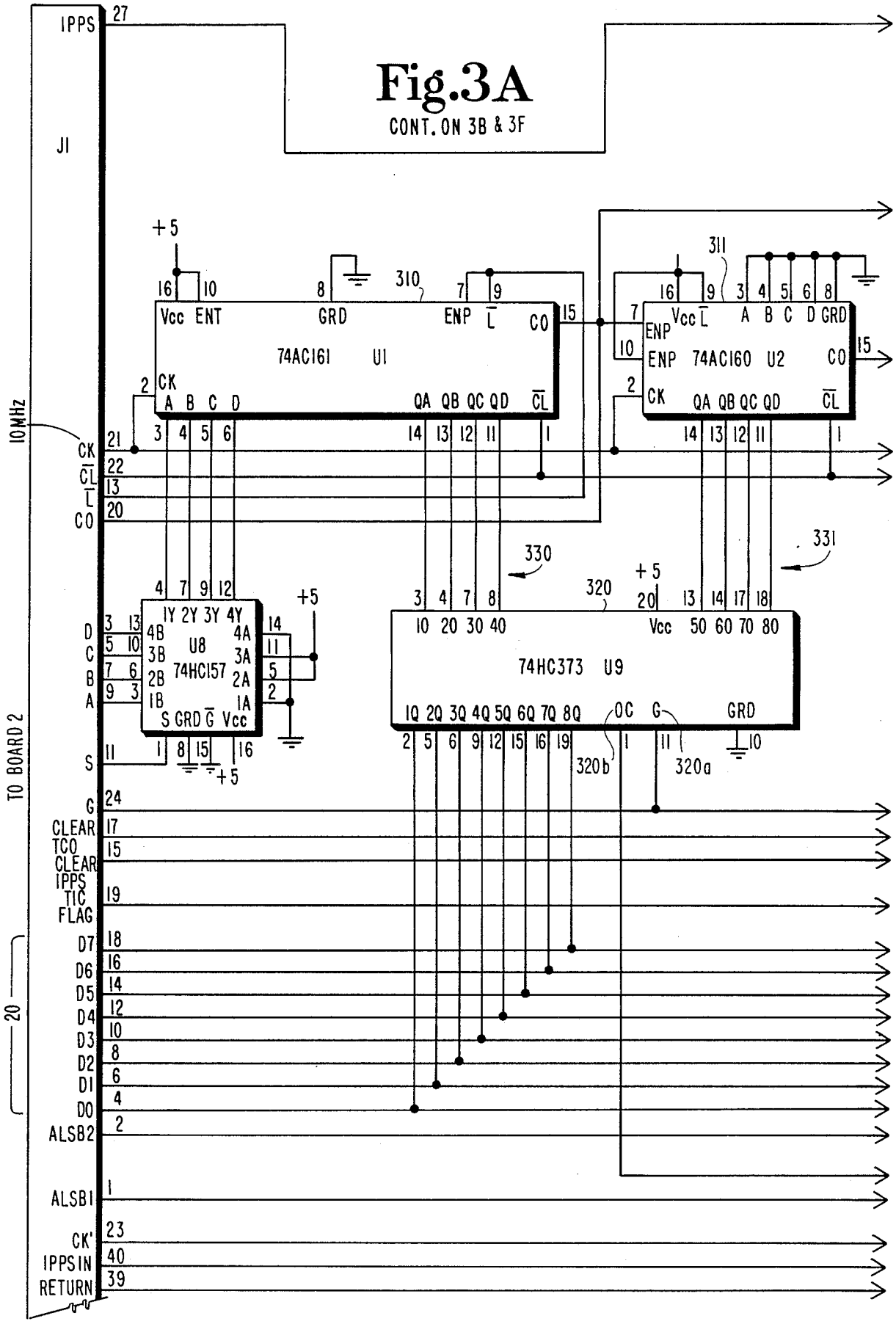
FIGS. 3 and 4 are circuit diagrams of a preferred embodiment of the time interval counter means of FIG. 2C, more specifically FIGS. 3A through 3G comprise the diagram of a circuit board carrying the counter means and time interval, latch means of FIG. 2C, and FIGS. 4A through 4E comprise the diagram of a circuit board carrying the sub interval signal generator, pulse generator, sub-sub interval signal generator and sub interval latch means of FIG. 2C.
Figure 3B:
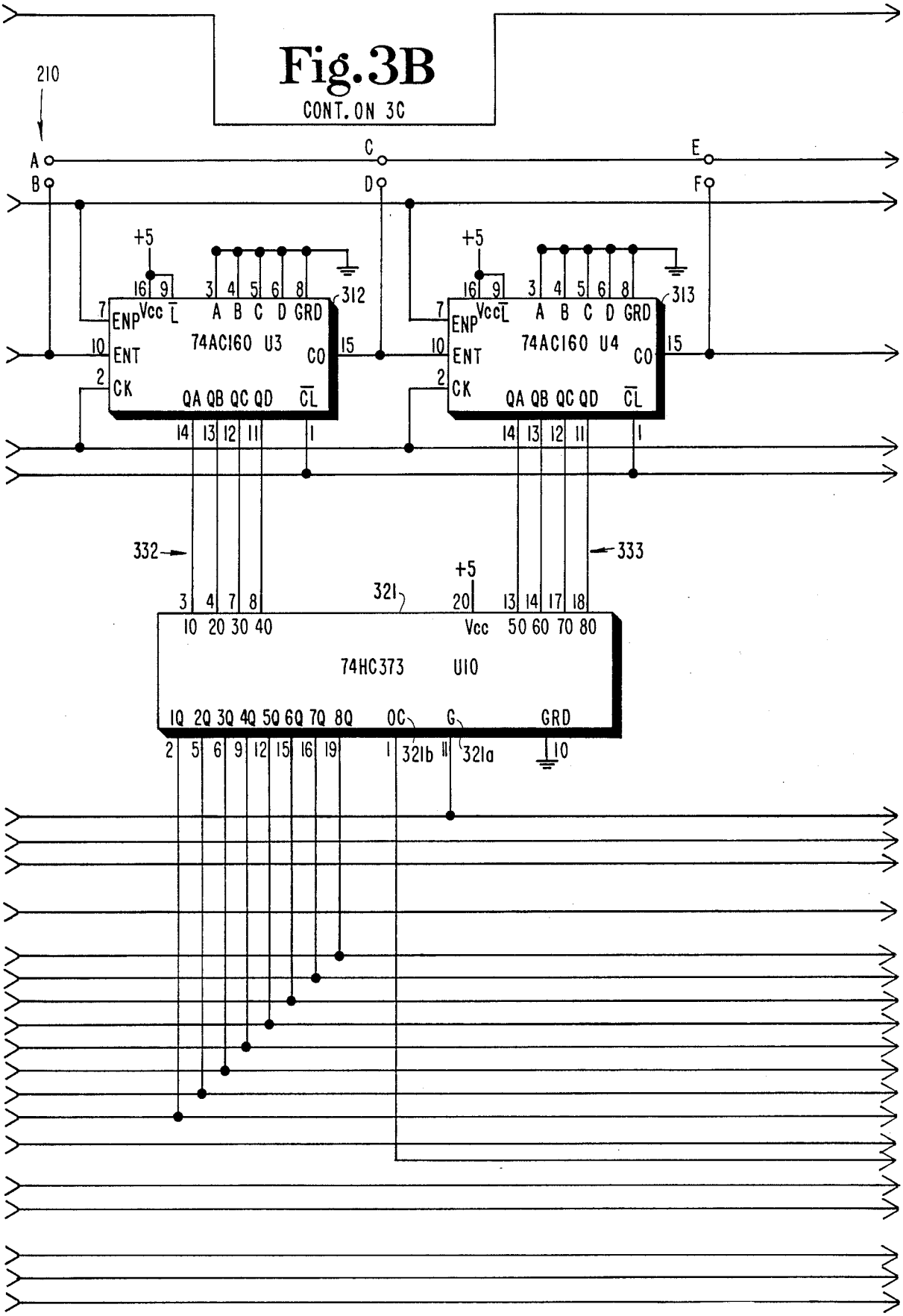
Figure 3C:
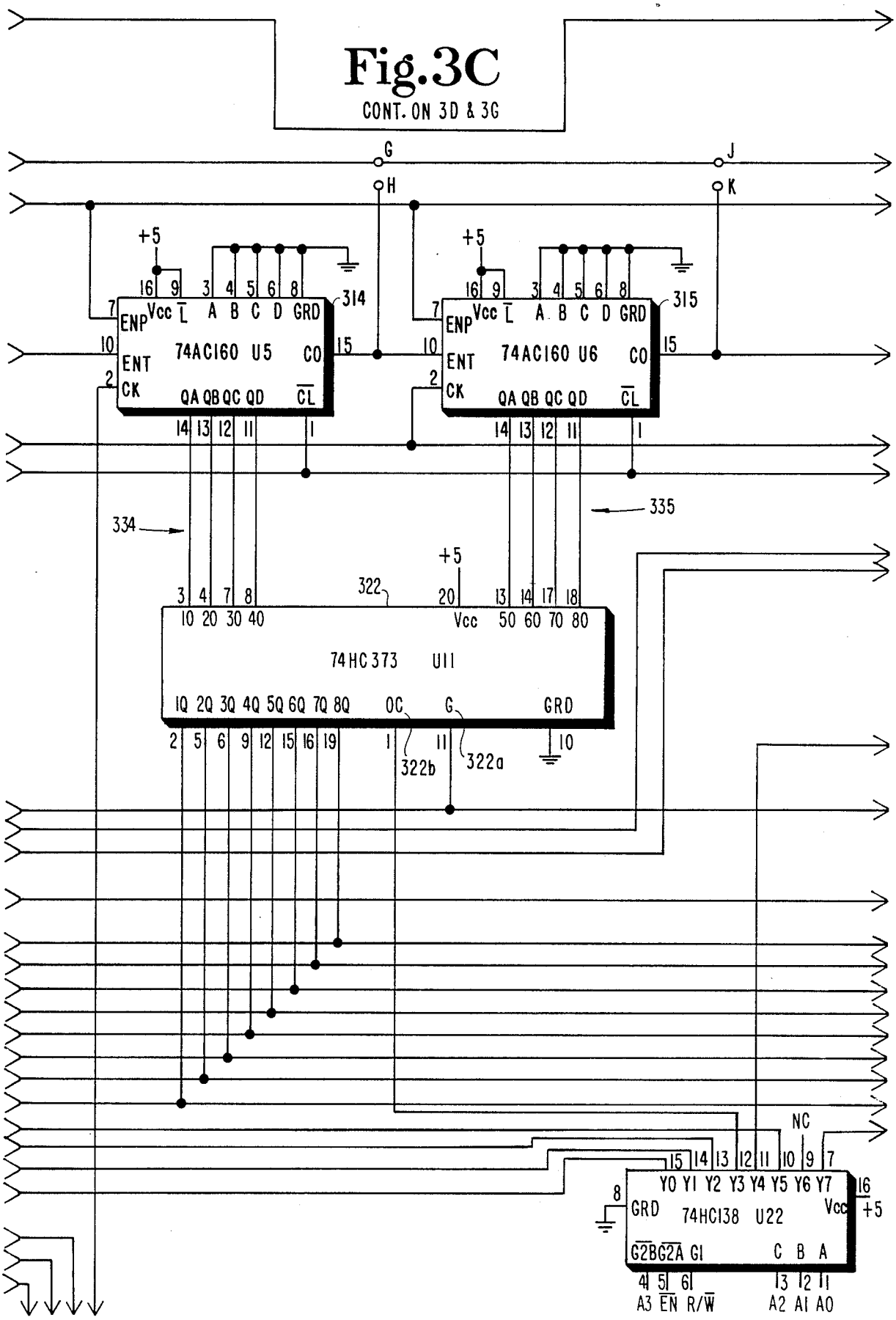
Figure 3D:
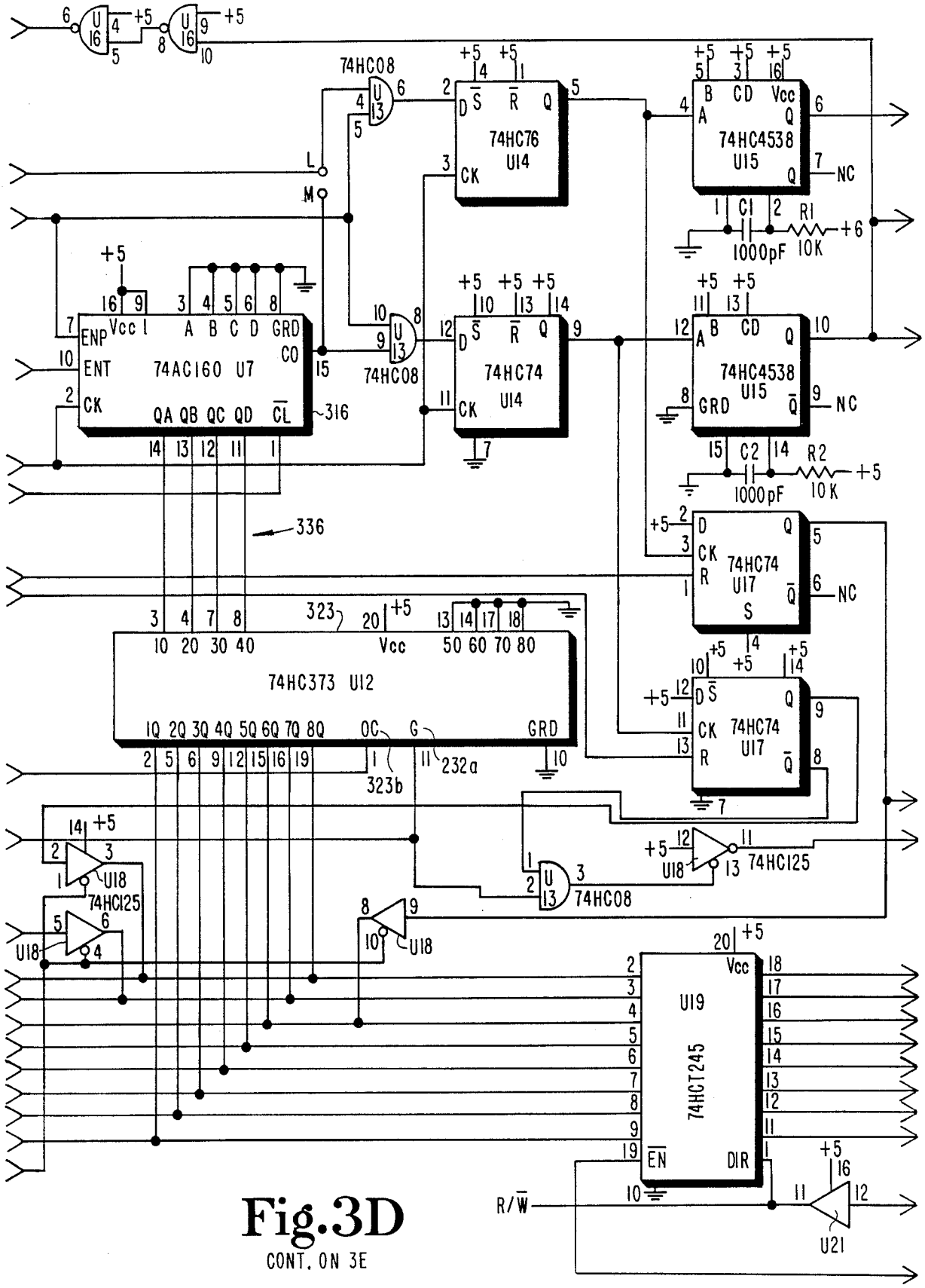
Figure 3E:
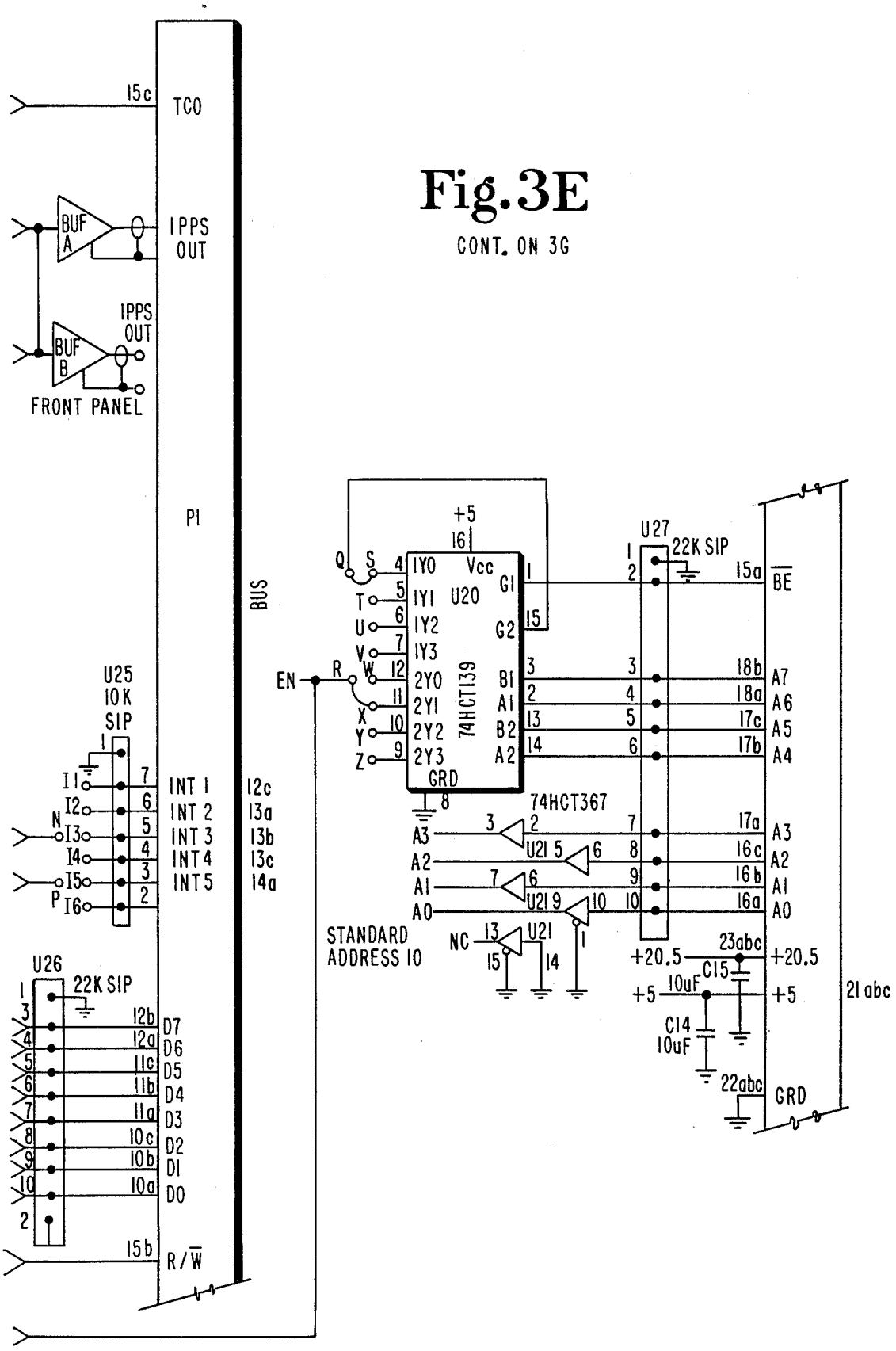
Figure 3G:
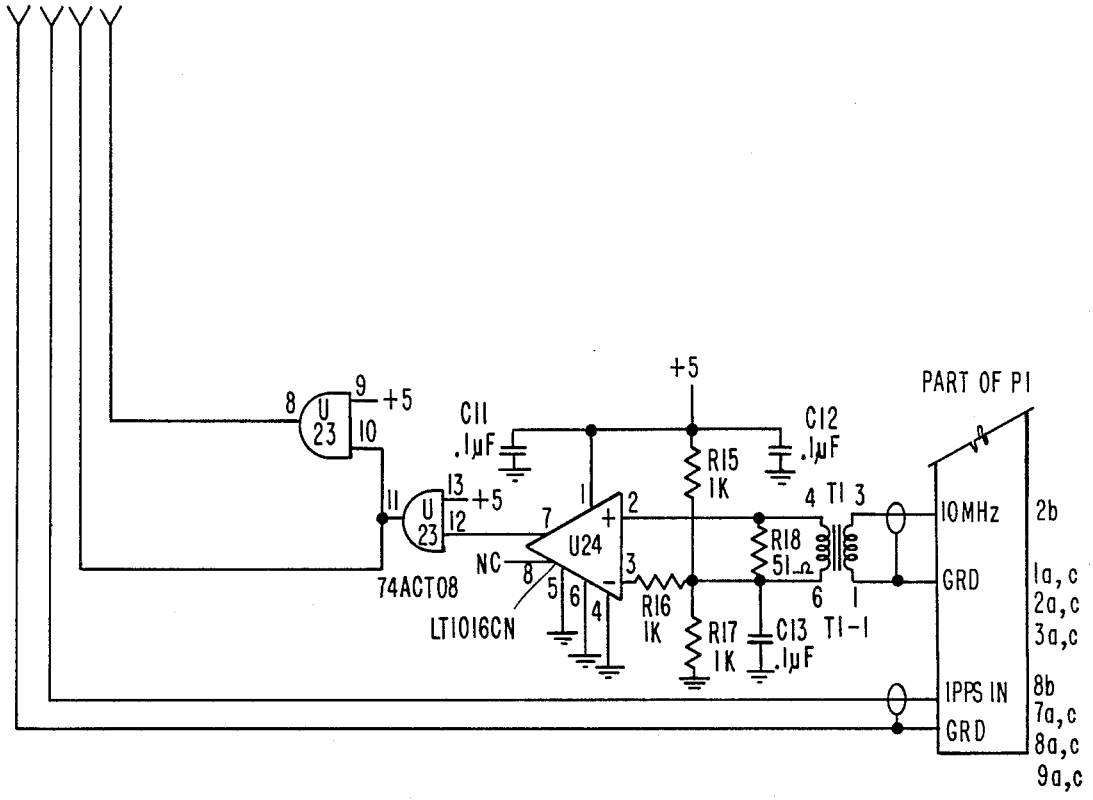

FIGS. 3A through 3G and 4A through 4E are schematics of the time interval counter means of FIG. 2C. Because the circuit of the time interval counter is too complex and extensive to be shown on a single sheet of patent drawings, the circuit diagram is shown on FIGS. 3A through 3G and FIGS. 4A through 4E. FIGS. 3A through 3G illustrate the circuit diagram of one board (BOARD 1) of the preferred time interval counter means of FIG. 2C. FIGS. 3A through 3G can be assembled to provide the complete circuit diagram by positioning FIG. 3B at the right of FIG. 3A and aligning the arrows indicating a continuation of the connections, positioning FIG. 3C at the right of FIG. 3B with their arrows aligned, positioning FIG. 3D at the right of FIG. 3C with their arrows aligned, positioning FIG. 3E at the right of FIG. 3D, positioning FIG. 3F at the bottom of FIG. 3A and positioning FIG. 3G at the bottom of FIG. 3C (Part of P1, the remainder of which is shown on FIG. 3E, is shown at the right of FIG. 3G).

As shown in FIG. 3, the counter means 210 comprises U1–U7 (310–316, respectively). These counters are 74AC161 (U1) and 74AC160 (U2-U7) semiconductor counter devices manufactured by Fairchild. As shown on FIGS. 3A through 3D, devices U9–U12 (320–323) comprise time interval latch 220. The U9–U12 devices are 74HC373 octal transparent latches with three-state outputs manufactured by Fairchild. The count of counters 310–316 is applied in binary code to the time interval latch means 320–323 over connections 330–336, respectively.

The external standard one pulse per second is applied to the G terminals of the U9–U12 devices (numbered **320*a*–323*a*, respectively). Upon the application of the external time standard pulse, the counts of counters 310–316 are latched in time interval latches 320–323. At the next available time following the "flag" and before the next external time standard pulse, the central processing unit 30 actuates the OC terminals of the U9–U12 devices (numbered 320*b*–323*b*, respectively) and reads the stored counts of time interval latches 320–323 over time interval data bus 20, indicated by D0–D7 on FIGS. 3A through 3E and FIGS. 4A through 4D. The connections leading to terminals 320*a*–323*a* and leading to 320*b*–323*b* of the U9, U10, U11, and U12 devices (320–323), respectively, are represented by connection 221 of FIG. 2. The stored counts represent the number of 100-nanosecond time intervals between the internally generated one pulse per second and the external standard one pulse per second. The central processing unit 30** stores this information.

FIGS. 4A through 4E comprise a schematic diagram of a second board (BOARD 2) of the time interval counter showing the subinterval signal generator 230, the sub-subinterval signal generator 250, and the subinterval latch means 240–249 of FIG. 2C. The complete circuit diagram can be assembled by positioning FIG. 4B to the right of FIG. 4A with the arrows aligned, positioning FIG. 4C to the right of FIG. 4B with the arrows aligned, positioning FIG. 4D to the right of FIG. 4C with the arrows aligned and by positioning FIG. 4E at the bottom of FIG. 4D. In the system, BOARD 2 of FIGS. 4A through 4Ea is connected to BOARD 1 of FIGS. 3A through 3G at the connection shown at the right of FIGS. 4D and 4E and at the left of FIGS. 3A and 3F.

Figure 4C:
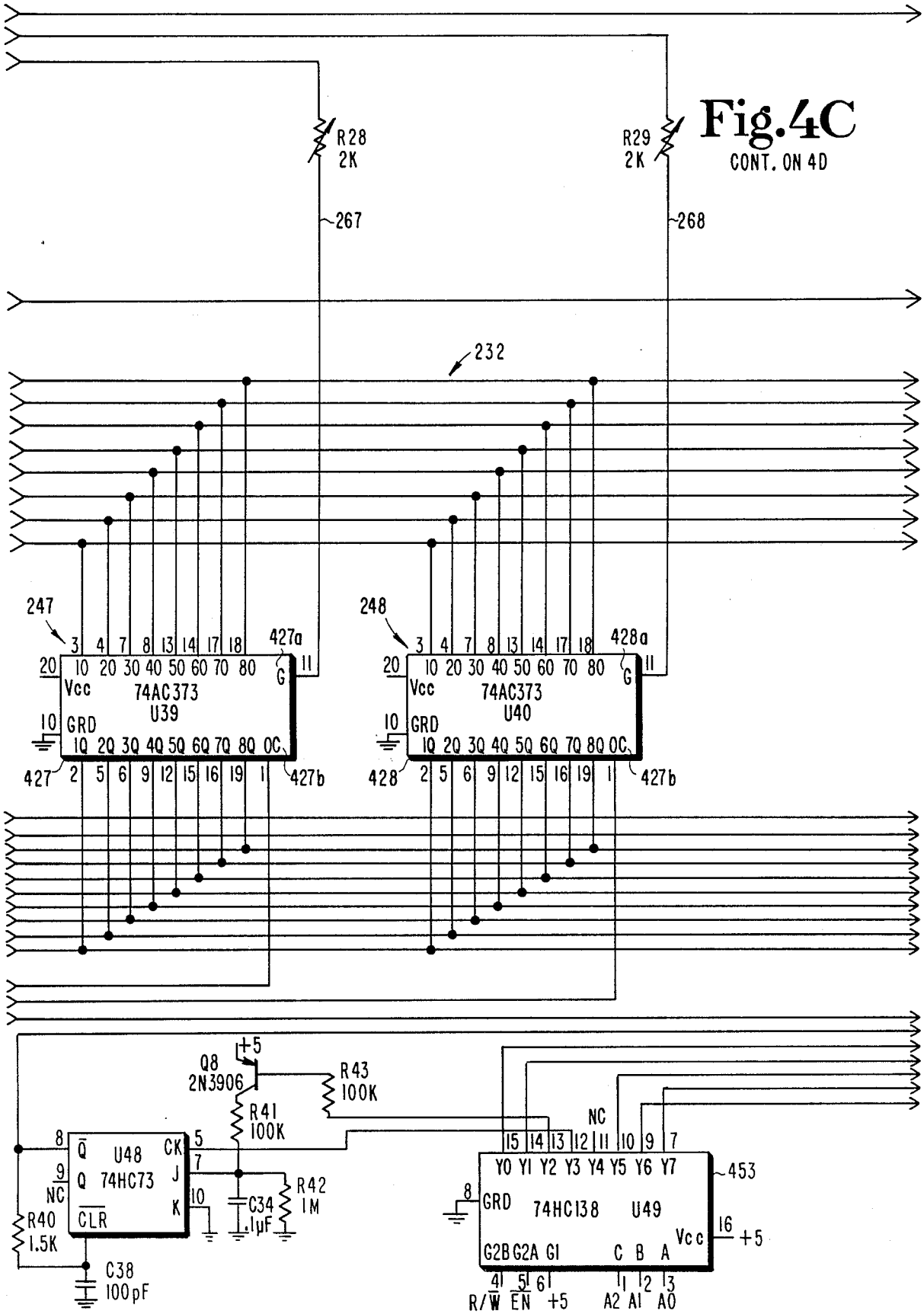

As shown in FIG. 4A, delay line U30 (410) comprises the subinterval signal generator 230 of FIG. 2C. The U30 device may be a passive delay line of the type sold by JBM Electronics, Inc., Manchester, New Hampshire 03102, under its designation L-21-27. The external standard pulse is applied through buffering devices U43 (411) and U29 (412) to IN terminal 411*a* of the U30 device. As shown in FIG. 4A, the U30 device provides eight outputs (410*a*–410*h*) at 12.5-nanosecond intervals, thus providing an output at 410*a* of 12.5 nanoseconds after the application of the external standard pulse to U30, an output at 410*b* 25.0 nanoseconds after external pulse application, an output at 410*c* 37.5 nanoseconds after external pulse application, an output at 410*d* at 50.0 nanoseconds after external pulse application, an output at 410*e* at 62.5 nanoseconds after external pulse application, an output at 410*f* at 75 nanoseconds after external pulse application, an output at 410*g* at 87.5 nanoseconds after external pulse application, and an output at 410*h* at 100.0 nanoseconds after external pulse application. The outputs 410*a*–410*h* change from low "0" to high "1" at uniformly spaced intervals of time within a 100-nanosecond time interval and may be considered, at any instant of time, binary coded representation of the time after application of the external pulse. The digitally coded outputs of subinterval signal generator 410 thus appear, after buffering by the U31 device (413), on the subinterval data bus 232, as shown in FIGS. 4A through 4D.

Devices U32–U41 (420–429), respectively, correspond to the subinterval latch means 240–249, respectively of FIG. 2C. Each of the U32–U41 (420–429) devices comprises octal transparent latches with threestate outputs sold under the designation 74AC373 by Fairchild. The binary coded outputs at terminals 410*a*–410*h* of U30 device (410) are applied through the subinterval data bus 232 to the inputs of each of the subinterval latch means U32–U41 (420–429) as shown in FIGS. 4A through 4D. Latching of the subinterval latch means U32–U41 is effected by the signal applied at their terminals 420*a*–429*a*, respectively.

The latching signals for subinterval latch means U32–U41 are generated by device U28 (430), shown on FIG. 4A, which corresponds to the sub-subinterval signal generator 250 of FIG. 2C. The U28 device is a passive delay line of the type sold by JBM Electronics, Inc., under its designation L-21-273. Upon the application of a pulse to the U28 device (430), it generates ten outputs, each delayed in time 1.25 nanoseconds from the prior output. That is, the output at terminal 430*a* is delayed 1.25 nanoseconds after the application of the pulse; the outout at terminal 430*b* is delayed 2.5 nanoseconds after the application of a pulse; the output at terminal 430*c* is delayed 3.75 nanoseconds after the application of the pulse, and so on, to provide ten outputs at respectively 1.25, 2.5, 3.75, 5, 6.25, 7.5, 8.25, 10, 11.25, and 12.5 nanoseconds after pulse application. An IN terminal 431 of the U28 device is connected through the U47 device with the output (Q terminal, 432*c*) of the portion of the U48 device (432) shown on FIG. 4E, a 74HC73 devoce of the type manufactured by RCA. (The connection between the U28 device and the U47 device is omitted from FIGS. 4A through 4E to avoid confusion in showing the device interconnections.) The U48 device generates a pulse to operate the sub-subinterval signal generator U28 (430) by sensing the arrival of the external standard pulse at its "J" terminal 432*a* and by generating a pulse at terminal 432*c* for application to the "IN" terminal 431 of delay line U28 at the next ten MHz timing pulse sensed at its "CK" terminal 432*b*.

The outputs of the sub-subinterval signal generator 250 (U28, 430) are applied, in order, to terminals 420*a*–429*a* of the subinterval latch means 240–249 (U32–U41, 420–429), as shown in FIGS. 4A through 4D, and latch the outputs of the subinterval signal generator 230 (U30, 410) in devices U32 through U41 at progressive 1.25-nanosecond time intervals after the application of the timing pulse to the terminal 431 of the sub-subinterval signal generator 250, the U28 device number 430 on FIG. 4A.

The contents of devices U32–U41, the subinterval latch means, are read by the central processing unit (not shown on the sheets comprising FIGS. 3 and 4) by application of signals to terminals 420*b*–429*b* of the subinterval latch means U32–U41 as shown in FIGS. 4A–4D. Read signals are applied by the central processing unit to terminals 420*b*–429*b* of U32–U41 through the U44 device (440) which is a 74HC138 device. Upon receipt of the read signal at terminals 420*a*–429*b*, the binary coded outputs from terminals 410*a*–410*h* of the subinterval generator 30 (the coded representations of time after the external pulse) which have been stored in subinterval latch means 240–249 (U32–U41, 420–429) appear on the data bus 20 (FIGS. 4A through 4D and FIGS. 3A through 3E) and are read and stored by the central processing unit 30 for processing as set forth above. Each of the passive delay lines U28 (430) and U30 (410) is terminated by impedance matching devices 435 and 415, respectively, as shown in FIG. 4A to dissipate the pulses and prevent reflections within the U28 and U30 devices.

Figure 4E:
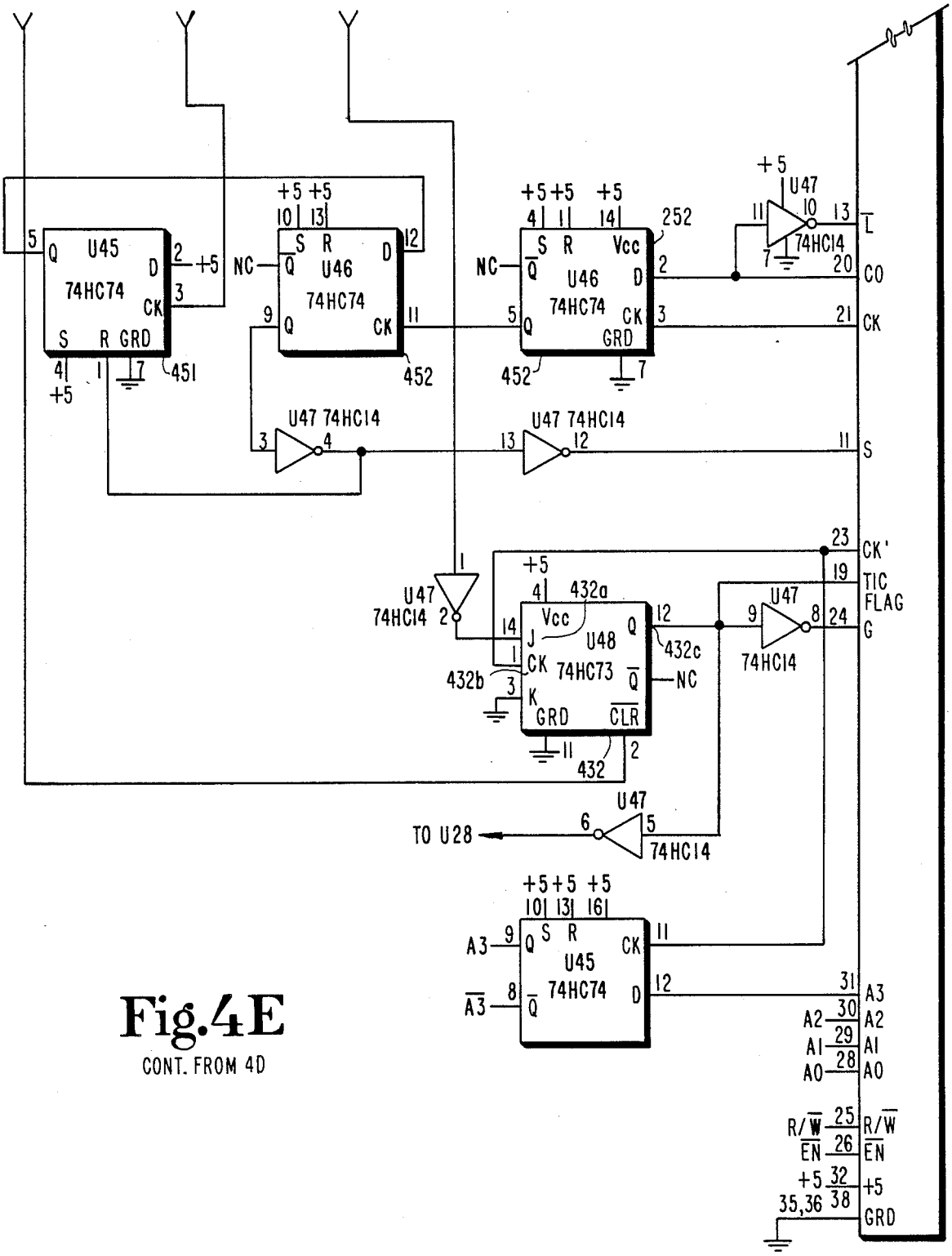

As shown on FIGS. 4D and 4E, devices U42 (450), U45 (451) and U46 (452) provide the time interval adjustment function 280 of FIG. 2C. The U45 and U46 devices (451, 452) of the time interval adjustment means slew counters U1–U7 to adjust the internally generated one pulse per second to correspond to a designated relative time interval with the external standard one pulse per second within ± 100-nanoseconds. The U42 device 450 adds or subtracts pulses to the first counter U1 of counter means 210. The time interval adjustment means (450, 451, 452) accomplish the adjustment by subtracting from the count of counters U1–U7 a number of counts corresponding to the number of 100-nanosecond intervals determined by the central processing unit 30 to exist between the internally generated one pulse per second and the desired relative time interval.

The invention permits an internally generated one pulse per second to be compared with the external standard one pulse per second to a ± 1.25 nanosecond resolution. The invention uses the precision of passive delay lines and low power consumption, high-speed CMOS devices to avoid the high-power consumption and complex calibration techniques traditionally required with obtaining comparable resolutions. Furthermore, the invention can be incorporated into an atomic clock without destroying the portability of the clock, thus permitting the transportation of accurate times. Atomic clocks incorporating this invention may also provide outputs of five, one, and ten MHz at one-volt rms into a 50-ohm load, and can be operated from an AC outlet or from a DC power source that can provide field operations for up to six hours on internal batteries. The long-term stability of the internally generated signals of such an atomic clock is $1\times10^{-11}$ per month. The unit may be operated from $-10°$ C. to in excess of 40° C. and at altitudes up to 4,000 feet, and can be housed within a container approximately six inches high by ten inches wide by fifteen inches long.

A number of specific semi conductor devices and manufacturers have been identified in the drawings and description of the time interval counter of this invention; however, it will be apparent to those skilled in the art that the invention can be practiced with devices other than or additional to those shown and described above.

While I have described a presently preferred embodiment of the invention, other embodiments of the invention may become apparent to those skilled in the art. The invention is intended to be limited only by the scope of the following claims.

I claim:

1. A time interval counter for determining the time interval between an external signal and one of a series of timed signals occurring at known time intervals, comprising:

first means, operated by the external signal, for producing a plurality of binary outputs spaced from each other by a plurality of known time intervals that are substantially less than the known time interval of the series of timed signals, said plurality of binary outputs forming a coded representation of the time interval following the external signal;

second means, operated by the timed signal following the external signal, for producing a plurality of sequential outputs spaced from each other by a plurality of known sub-time intervals that are substantially less than the known time intervals of the binary outputs of the first means; and third means for storing the plurality of binary outputs and coded representations of the time interval after the external signal at each of the sub-time intervals produced by said second means, and for determining the time interval between the external signal and the timed signal following the external signal by decoding the stored binary outputs and coded representations of the time interval following the external signal, by comparing the stored coded representations of the time interval following the external signal at each of the sub-time intervals to determine the number of sub-time intervals represented by any change in the stored coded representations, and by combining the decoded time interval and number of sub-time intervals to determine the total time interval following the external signal.

2. The time interval counter of claim 1 wherein the first means is a subinterval signal generator for generating n sequential outputs equally spaced in time by periods of $$\frac{1}{f\times n}.$$

3. The time interval counter of claim 1 wherein the external signal is a pulse with a width greater than the known time interval and the first means is a passive delay line with n sequential outputs equally spaced in time by periods of $$\frac{1}{f\times n}.$$

4. The time interval counter claim 2 wherein the spaced means is sub-subinterval signal generator for generating p sequential outputs equally spaced in time by periods of $$\frac{1}{p\times n\times f}.$$

5. The time interval counter of claim 2 wherein the second means is a passive delay line with p sequential outputs equally space din time by periods of $$\frac{1}{p\times n\times f}$$

operated by a pulse coinciding in time with the timed signal following the external signal and having a pulse width at least equal to 1/n.

6. The time interval counter of claim 1 wherein the third means includes a plurality of substantial latch means, each subinterval latch means being connected with said first means and said second means, each of said subinterval latch means being operated in sequence by one of the plurality of sequential outputs of said second means to store the plurality of binary outputs and coded representations of the time interval after the external pulse at each of the sub-time intervals produced by the second means.

7. The time interval counter of claim 6 wherein the third means includes a plurality of octal transparent latches with three-state outputs and a central processing unit.

8. An atomic clock including means for determining the time interval between an internal time signal and an external time signal to within less than two nanoseconds, comprising:

atomic frequency generation means for generating an accurate ten-MHz signal and a series of 100-nanosecond time intervals;

a time interval counter means and a central processing unit for generating the internal time signal and for determining the time interval between the internal time signal and the external time signal; and means to display the time interval between the internal time signal and the external time signal, said time interval counter means, comprising:

means to count the number of 100-nanosecond time intervals between the internal time signal and external time signal and to store the number of 100-nanosecond time intervals in the central processing unit;

a subinterval signal generator operated by the external time signal for developing eight sequential outputs equally spaced from each other in time, with each output commencing 12.5 nanoseconds after the preceding output, and for producing a coded representation of the time interval following the external time signal;

a sub-subinterval signal generator operated with the output of the atomic frequency generation means for developing ten outputs equally spaced from each other in time, with each output commencing 1.25 nanoseconds after the preceding output;

ten subinterval latch means, each of said ten subinterval latch means being connected with said subinterval signal generator so that said eight outputs of said subinterval signal generator means are applied to the inputs of each of said ten subinterval latch means, each of said ten subinterval latch means also being connected with a different one of the outputs of the sub-subinterval signal generator, said ten subinterval latch means being latched sequentially at 1.25-nanosecond intervals from first through a tenth subinterval latch means by the sequential outputs of the sub-subinterval signal generator to store the coded representations formed by the eight outputs of the subinterval signal generator in each of the ten subinterval latch means at progressive time intervals of 1.25 nanoseconds each; and means connecting the ten subinterval latch means and central processing unit, said central processing unit being adapted for reading the subinterval latch means following receipt of the external time signal and for storing the coded representations formed by the eight outputs of the subinterval signal generator that have been stored at progressive 1.25-nanosecond time intervals in the first through the tenth subinterval latch means, said central processing unit being further adapted for determining the time interval between the internally generated time signal and the external time signal by combining the time corresponding to the number of 100-nanosecond time intervals stored in the central processing unit, the time corresponding to the coded representation stored in the first of said subinterval latch means, and the time corresponding to the number of 1.25-nanosecond time intervals of the earliest subinterval latch means with a stored coded representation of the subinterval signal generator which does not match the stored coded representation of the first subinterval latch means.

9. In an atomic clock including means to determine the time interval between an internally generated one pulse per second and an externally generated one pulse per second, including an atomic-oscillation, stabilized high-frequency generator providing series of time signals accurately spaced in time equal to 1/f; counter means; a central processing unit; and means for generating one pulse per second from the output of the frequency generator and for counting the number of accurately spaced time signals between the internally generated one pulse per second and the externally generated one pulse per second, the improvement comprising:

a subinterval signal generator means, activated by the externally generated one pulse per second, for generating n sequential outputs equally spaced in time by periods of $$\frac{1}{n \times f}$$

after its activation to provide a coded representation of the time interval within the 1/f time interval following the counted number of accurately spaced time signals after the internally generated one pulse per second;

a sub-subinterval signal generator means, activated by the accurately spaced time signal next following the externally generated one pulse per second, for producing p sequential outputs, each of said p sequential outputs being equally spaced in time and following the preceding output by a precise interval of time equal to $$\frac{1}{p \times n \times f};$$

and p subinterval latch means, each of said p subinterval latch means being connected with the n outputs of the subinterval signal generator to permit storage of the n outputs providing a coded representation of the time following activation of the subinterval signal generator by the externally generated one pulse per second, , each of said p subinterval latch means being connected with one of the p outputs of the sub-subinterval generator to activate each of the subinterval latch means in a succession of time intervals of $$\frac{1}{p \times f \times n}$$

to store in each subinterval latch means at the time of its activation by the connected p output of the sub-subinterval generator, the n outputs and coded representation of the time following activation of subinterval signal generator, wherein said central processing unit reads the subinterval latch means upon activation by the accurately time spaced signal next following the externally generated one pulse per second and determines the time interval therebetween, with a resolution of $$\frac{1}{p \times n \times f},$$

from the time represented by the counted number of accurately spaced time signals and from the stored coded representations of the time following activation of the subinterval signal generator by the externally generated one pulse per second.

10. The atomic clock of claim 9 wherein said externally generated one pulse per second has a pulse width of about 1/f and said subinterval signal generator and sub-subinterval signal generators are passive delay lines.

11. The atomic clock of claim 10 wherein said subinterval latch means are octal transparent latches with three state outputs.

12. The atomic clock of claim 9 wherein said high frequency is ten MHz, 1/f equals 100 nanoseconds, said externally generated one pulse per second has a pulse width of at least 100 nanoseconds, said subinterval signal generator is a passive delay line, n equals eight to provide eight outputs, $$\frac{1}{n \times f}$$

equals 12.5 nanoseconds, said sub-subinterval generator is a delay line, p equals ten and $$\frac{1}{p \times n \times f}$$

equals 1.25 nanoseconds.

13. In a method of determining the time interval between an external signal and a timing signal which is one of a series of timing signals having f precise periods of time 1/f, the steps comprising:

processing the external signal to produce n sequential outputs, each of the n sequential outputs being equally spaced in time and commencing at times delayed from each other by periods of $$\frac{1}{n \times f};$$

processing the timing signal occurring next after the external signal to produce p sequential outputs, each of the p sequential outputs being equally spaced in time and commencing at times delayed from each other by periods of $$\frac{1}{p \times n \times f};$$

sampling the n outputs at the times corresponding to each of the p sequential outputs and storing the sampled n outputs at time times corresponding to each of the p sequential outputs;

reading the stored sampled n outputs and comparing the stored n outputs to determine the $$\frac{1}{p \times n \times f}$$

period when a mismatch occurs in the stored n outputs; and calculating the time interval between the external signal and timing signal to an accuracy of $$\frac{\pm 1}{p \times n \times f}$$

from the sampled n outputs and the $$\frac{1}{p \times n \times f}$$

period at which a mismatch in the sampled n outputs is detected.

14. The method of claim 13 including the further steps of determining the time interval between an internally generated time signal and said external signal by counting the number of timing signals between an internally generated time signal and said external signal and adding the determined time interval to the calculated time interval between the external signal and timing signal and displaying the time interval between the internally generated time signal and the external standard time signal.

* * * * *